US007823933B2

(12) United States Patent
Layos et al.

(10) Patent No.: US 7,823,933 B2
(45) Date of Patent: Nov. 2, 2010

(54) ROTATING DISK SYSTEM FOR A VEHICLE DOOR LATCH ASSEMBLY

(75) Inventors: Aaron J. Layos, Fort Wayne, IN (US); Mark S. Jeffries, Cumming, GA (US); Lee S. Weinerman, Medina, OH (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 540 days.

(21) Appl. No.: 11/832,022

(22) Filed: Aug. 1, 2007

(65) Prior Publication Data

US 2009/0033108 A1 Feb. 5, 2009

(51) Int. Cl.
*E05C 9/10* (2006.01)
*E05B 3/08* (2006.01)

(52) U.S. Cl. ..... 292/37; 292/38; 292/49; 292/50; 292/336.3

(58) Field of Classification Search ..... 292/37, 292/38, 42, 49, 50, 54, 336.3
See application file for complete search history.

(56) References Cited

U.S. PATENT DOCUMENTS

| | | | | |
|---|---|---|---|---|
| 1,180,123 | A * | 4/1916 | Florcken | 292/33 |
| 1,404,476 | A * | 1/1922 | McCulloch | 292/54 |
| 4,470,277 | A * | 9/1984 | Uyeda | 70/118 |
| 4,917,412 | A * | 4/1990 | Swan et al. | 292/48 |
| 5,117,665 | A * | 6/1992 | Swan et al. | 70/264 |
| 6,017,067 | A * | 1/2000 | Yoneyama et al. | 292/216 |
| 6,101,853 | A * | 8/2000 | Herr | 70/109 |
| 6,578,446 | B2 | 6/2003 | Staser et al. | |
| 6,902,213 | B2 * | 6/2005 | Lee | 292/216 |

* cited by examiner

*Primary Examiner*—Carlos Lugo
(74) *Attorney, Agent, or Firm*—Jeffrey P. Calfa; Mark C. Bach

(57) ABSTRACT

A vehicle door latching assembly has a rotating disk assembly to open and latch a door with handles located remote to the latches. The door latching assembly has at least one handle assembly and a hub assembly. The hub assembly includes a rotatable disk mounted to a disk bracket assembly. At least one handle connector connects the hub disk assembly to the handle assembly. A latch connector connects to the hub disk assembly to upper and lower latch assemblies.

13 Claims, 10 Drawing Sheets

ROTATING DISK SYSTEM FOR A VEHICLE DOOR LATCH ASSEMBLY

BACKGROUND OF THE INVENTION

1. Field of the Invention

The present invention relates to door latching assemblies for vehicles, especially for motor vehicles like medium and heavy duty trucks and buses, and trailers.

2. Description of the Prior Art

Many motor vehicles use cables to allow the inside and outside door handles to operate the door latches independent of each other. For some motor vehicles, medium and heavy duty trucks for example, the door latching system typically includes inside and outside handles and their handle assemblies which are located remotely to the latch assemblies. The handles attach to cables located within the door. The latch assemblies have latch trip levers connected to the locking mechanism of the latch. Each cable connects to one handle assembly and to the bottom of the latch trip lever of the latch assembly. A rod attaches to the top of the trip lever of both the upper and lower rotary latch assemblies.

To open the door with the inside handle as shown in FIG. 1, for example, the inside handle 150 pulls the upper cable 152 toward itself. The cable 152 in turn pulls the bottom of the trip lever 154 toward the inside handle 150 and upward to unlatch the upper latch assembly 156 from the door. This action also moves the latch rod 158 upward to pull up the top of the trip lever 162 of the lower latch assembly 160, which pulls the bottom of the trip lever upward 162 and moves the cable 153 toward the outside handle 164. This action unlocks the lower latch assembly 160 and unlatches the door.

The door opens with the outside handle in a similar manner. Closing the door reverses the steps.

Unfortunately, the cables can break, rendering the doors inoperable. This makes it difficult to open and repair the door as well if the cable breaks with the door closed. Even when the door can be opened, the door must be disassembled to replace the broken cable.

Therefore, a need exists to provide a mechanism to allow the remote opening of door latches without requiring the use of a cable.

SUMMARY OF THE INVENTION

According to the invention there is provided a door latching assembly that can be used for vehicles. The door latching mechanisms uses a rotating disk assembly for allowing the opening and latching of a door with handles located remote to the latches. The assembly has at least one handle assembly and a hub assembly. The hub assembly has a rotatable disk mounting to a disk bracket assembly. At least one handle connector connects the hub assembly and the handle assembly. A latch connector connects to the hub assembly and the upper and lower latch assemblies.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
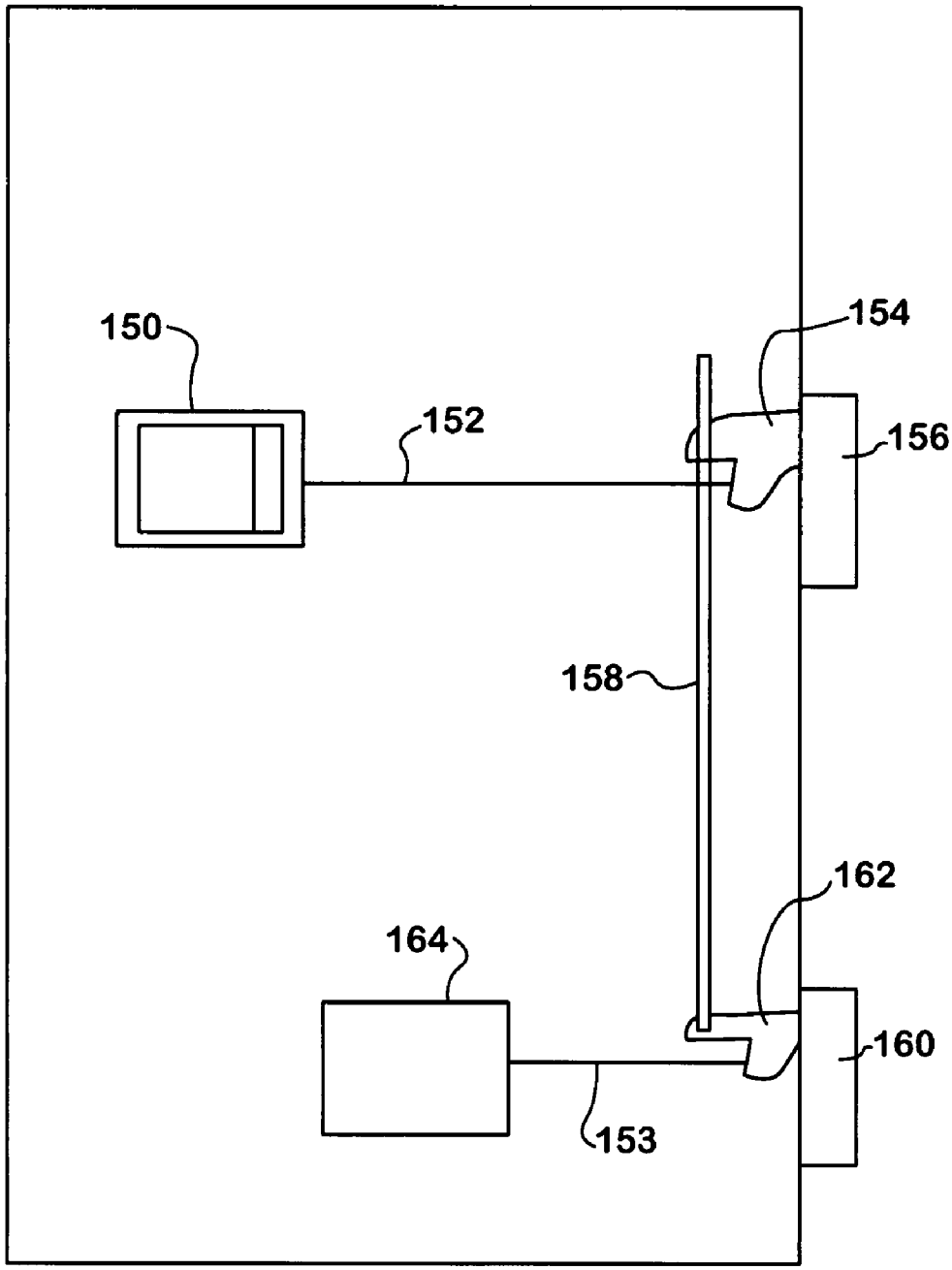
FIG. 1 PRIOR ART
FIG. 1 is front view of a prior art door latch assembly using cables attached to the latch assemblies.
Figure 2:
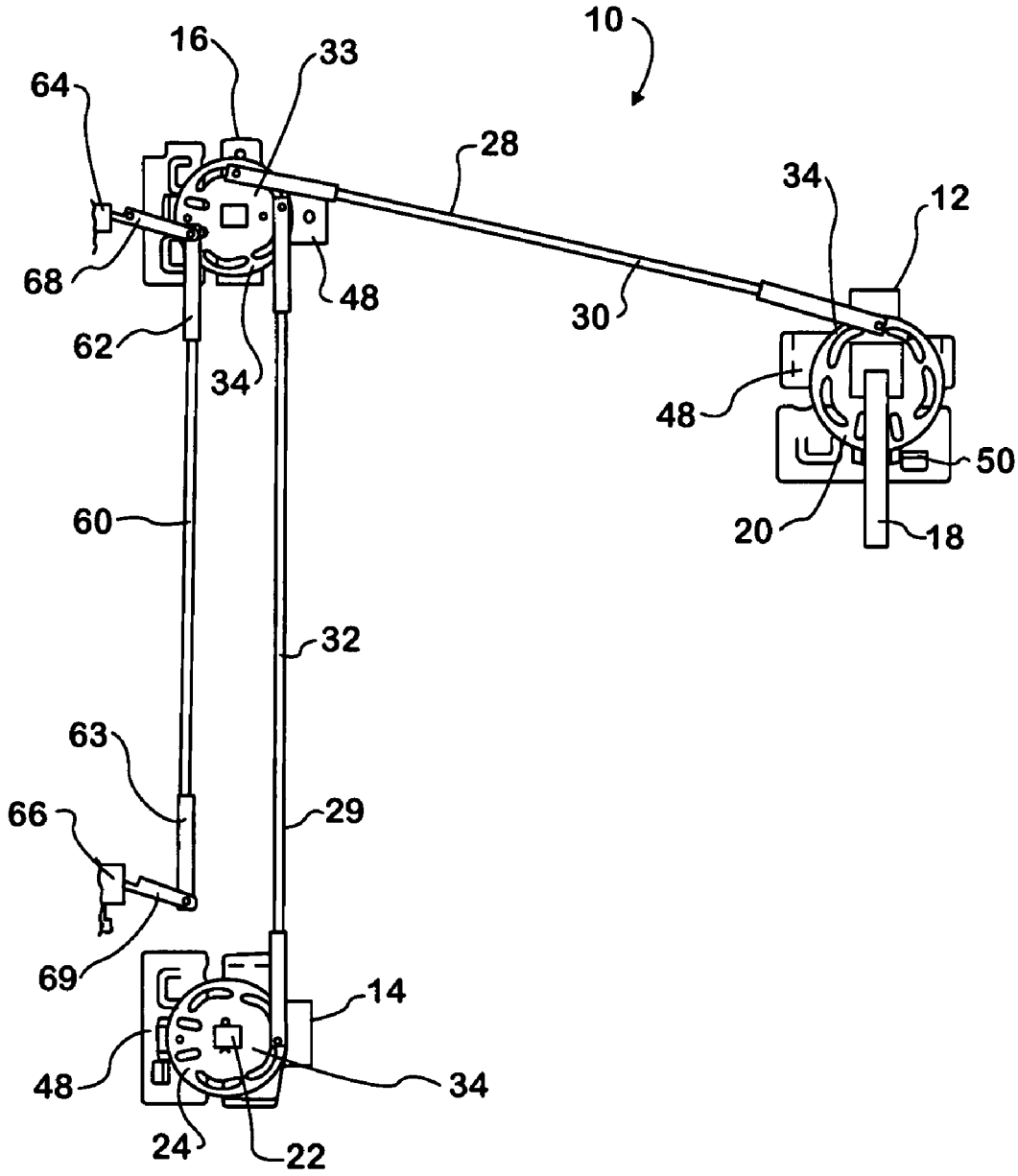
FIG. 2 is a front view of a door latch assembly of the invention.
Figure 3:
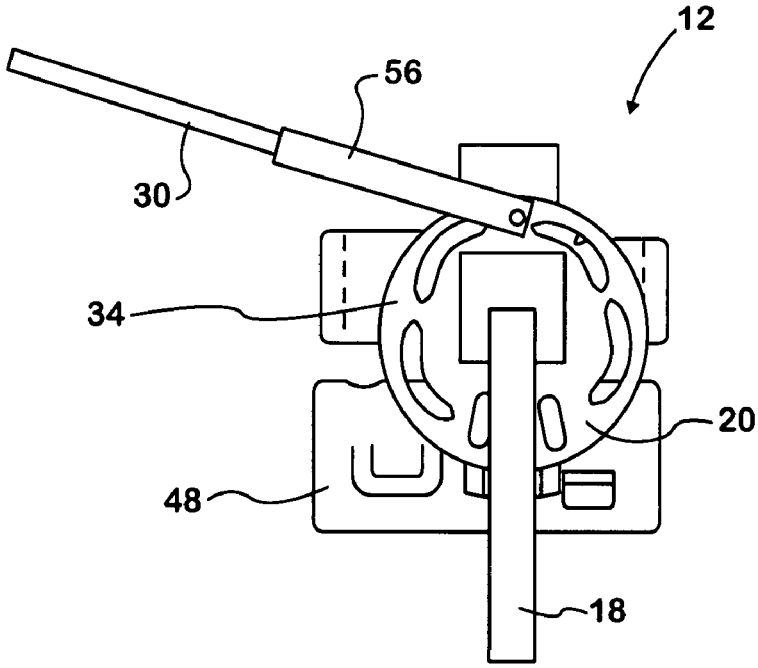
FIG. 3 is front view of a first handle assembly.

Referring to the Figures where like reference numerals refer to like structures, a vehicle door 11 has a door latch assembly 10 located at least partially within the door 11 between the interior and exterior skins. As shown in FIG. 2, the door latch assembly 10 has first and second handle assemblies 12, 14 connecting to a hub assembly 16. The first and second handle assemblies 12, 14 independently latch and unlatch the upper and lower latch assemblies 64, 66 to open and close the door 11.

The hub assembly 16 has a hub disk assembly 33 and disk bracket assembly 48 attached to the door 11. The hub disk assembly has a rotatable disk 34. The hub disk assembly 33 mounts to the disk bracket assembly 48.

The first handle assembly 12 has an interior handle 18 located on the inside of the door 11 outside of the interior skin. The interior handle 18 connects to a handle shank 21 of a first disk assembly 20 located within the door 11. The first disk assembly has a rotatable second disk 34 and is mounted to a second disk bracket assembly 48.

The second handle assembly 14 has an exterior handle 22 located on the outside of the door 11 and disk bracket assembly 48 attached to the inside of the door 11. The exterior handle 22 connects to a second disk assembly 24 with a rotatable third disk 34 and is located within the door 11. The second disk assembly 24 mounts to a third disk bracket assembly 48. For some vehicles, such as a truck, the exterior handle 22 is located near the bottom of the door 11 and can be padlocked on the outside.

Figure 5:
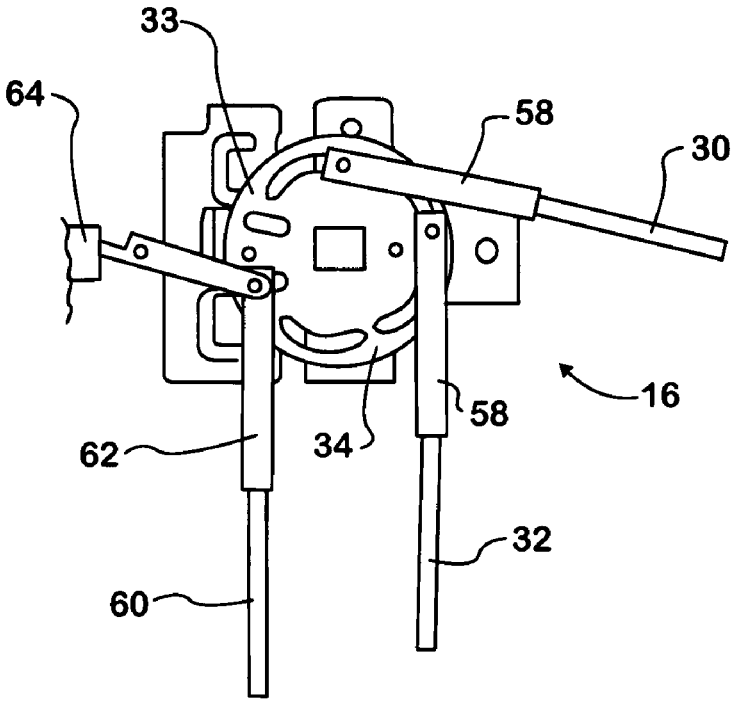
FIG. 5 is a front view of a hub disk assembly.
Figure 6:
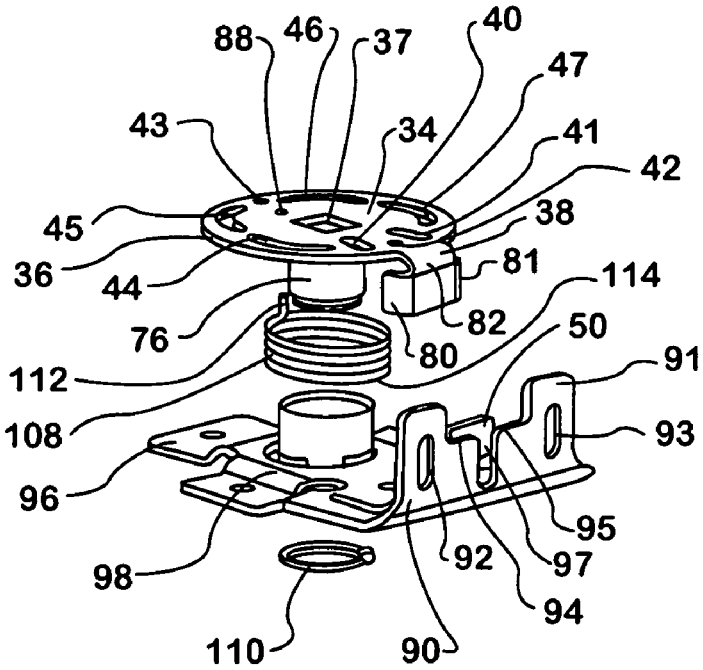
FIG. 6 is an exploded view of a hub disk and disk bracket assembly for a tension spring in a counterclockwise orientation.
Figure 7:
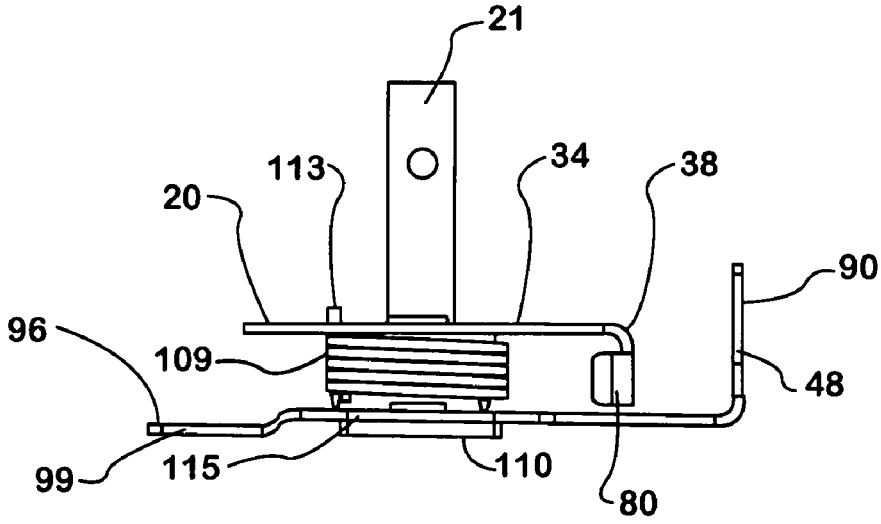
FIG. 7 is a side view of a handle disk assembly with a handle shank attached and a disk bracket assembly for a tension spring in a clockwise orientation of the invention.

Turning to FIG. 5-7 which are representative of the disk assemblies, each disk 34 has an outer edge 36 with peripheral slots 44, 45, 46, 47 and radial slots 40, 41 located near the edge 36. First and second radial slots 40, 41 extend from near the edge 36 toward the center 37 of the disk 34. First hole 42 and opposite second hole 43 are located near the outer edge 36 of hub 34. First hole is located between the first and second radial slots 40, 41. Peripheral slots 44, 45 are located between the first radial slot 40 and the second hole 43. Peripheral slots 46, 47 are located between the second radial slot 41 and the second hole 42. An opening 86 can be adapted to fit the handle shank 21 of a handle and is located at the center 37 of the disk 34. A bore 88 can be located between the second hole 43 and the center 37.

Figure 4:
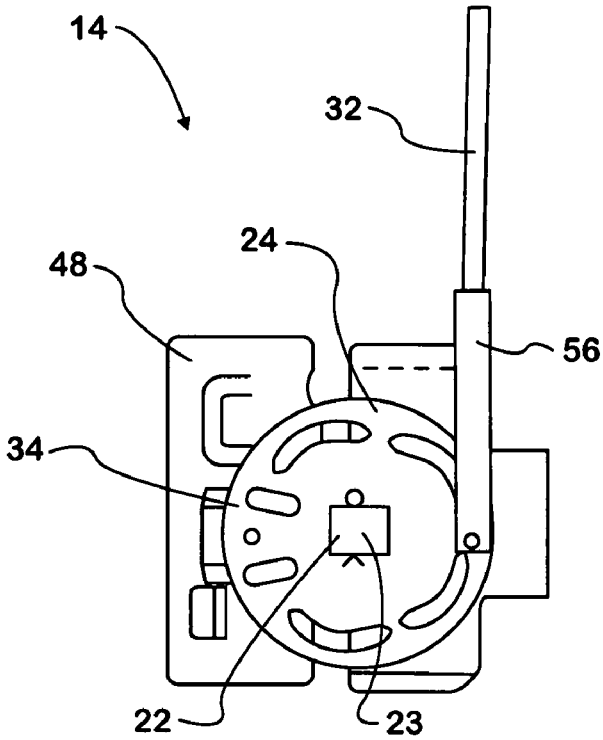
FIG. 4 is a front view of a second handle assembly.
Figure 8:
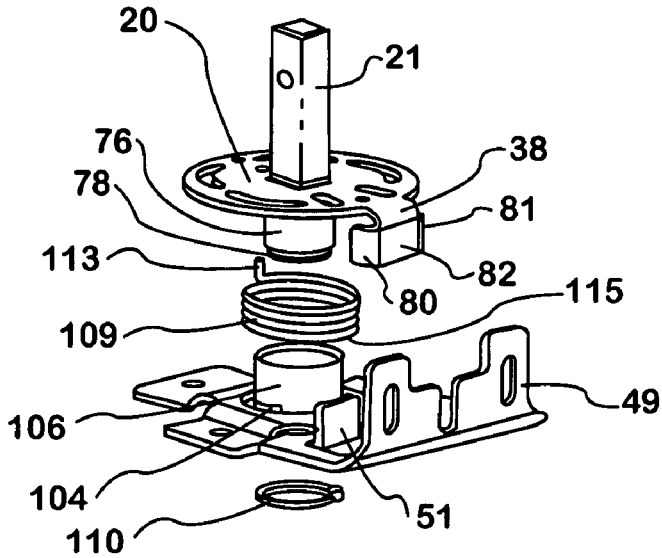
FIG. 8 is an exploded view of a handle disk with a handle shank and disk bracket assembly for a tension spring in a clockwise orientation.

FIGS. 7 and 8 show the first disk assembly 20 has the handle shank 21 mounted at the center 37 of disk 34 and can extend into the opening 86. FIG. 4 shows the handle shank 23 extending through the opening 86 of disk 34 of the second disk assembly 24.

A bearing shaft 76 extends outwardly from a face of the disk 34 at the center 37 and can border the opening 86. A groove 78 is located in the outside wall at one end of the bearing shaft 76 distal to the disk 34. The bearing shaft 76 can be hollow to allow a handle shank to fit within the bearing shaft 76 and through opening 86.

The disk 34 has a projection 38 with a base 82. The base 82 projects laterally from the edge 36 of the disk 34, then curves approximately parallel to the bearing shaft 76 toward the hub disk bracket assembly 48. The base 82 projects from at or near the radial slots 40, 41 and preferably between the radial slots 40, 41. Two arms 80, 81 can extend laterally from the base 82 and curve toward the bearing shaft 76.

Each disk bracket assembly 48, 49 has a mounting plate 96 with two lateral tabs 90, 91 projecting outwardly approximately 90 E at one end and head 99 at the opposite end. The mounting plate 96 can have opposite bracket arms 126, 127. The lateral tabs 90, 91 can have tab slots 91, 92 and shoulders 94, 95 with a gap 97 therebetween. A raised portion 98 is centrally located, preferably as part of the mounting plate 96. An aperture 100 in the raised portion 98 extends through the disk bracket assembly 48. A spring groove 102 in the raised portion 98 can surround the aperture 100.

A bracket tab 50, 51 projects outwardly from the mounting plate 96 approximately 90 E and parallel to one of the lateral tabs. The bracket tab 50 is located between the aperture 100 or raised portion 98 and lateral tab 91. Bracket tab 50 is used for doors having latches on the right side of the door when facing the door's interior (FIG. 2). Bracket tab 51 is used for doors with latches on the opposite side (FIGS. 8-13). The bracket tab 51 is located between the aperture 100 or raised portion 98 and lateral tab 90.

A collar 106 extends from the mounting plate 96 and borders the aperture 100, preferably within the spring groove 102. Adjusting holes 104 are located in the outer wall of collar 106.

A torsion spring 108, 109 surrounds the outer wall of the collar 106, with at least part of the spring 108, 109 fitting into the spring groove 102 if used. Spring 108, 109 returns the disk 34 to a home position. A disk end 112, 113 of the spring 108, 109 engages the bore 88 of the disk 34, while an opposite collar end 114, 115 engages one of the adjusting holes 104. Spring 108 has a counterclockwise return orientation, while spring 109 has a clockwise return orientation.

The bearing shaft 76 inserts within the collar 106, with the bearing shaft groove 78 exposed on the opposite side of the mounting plate 96. Once sufficient tension is produced by the spring 108, 109, a retainer 111 engages the bearing shaft 76 to hold the disk 34 in place, for example a retaining ring 110 fitting within the bearing shaft groove 78.

The home position of the disk 34 occurs when the projection 38 engages the bracket tab. In the home position, the torsion spring 108, 109 is set at the desired torque, such as 0.452 N-m. Once the torque is set, the retainer 111 is mounted onto the bearing shaft 76, such as within the bearing shaft groove 78.

The hub assembly 16 connects to the first and second handle assemblies 12, 14 with handle connectors 28, 29. Handle connectors 28, 29 have a first clevis 56 and an opposite second clevis 58 at the ends of cables or preferably handle rods 30. First and second clevises 56, 58 have opposite clevis arms 70, 71, 72, 73 with a clevis slot 84, 85 therebetween. The clevis arms 70, 71, 72, 73 can be the same length or different lengths.

The hub assembly 16 also engages a latch rod 60. The latch rod connects the upper and lower latch assemblies 64, 66. The latch rod 60 preferably has latch clevises 62, 63 at each end. An upper latch clevis 62 engages an upper latch lever 68 of the upper latch assembly 64. The lower latch clevis 63 engages a lower latch lever 69 of the lower latch assembly 66. The upper and lower latch clevises 62, 63 can have opposite latch clevis arms 116, 117 that are the same length or different lengths and a latch clevis slot 118 therebetween.

The first and second clevises 56, 58 engage the disks 34 at peripheral slots 44, 45. The upper latch clevis 62 engages the disk 34 of the hub assembly 16 at the radial slot 41. The outer edge 36 of the disks 34 fits within one of the clevis slots 84, 85, 118 of the clevises of the handle connectors and the latch clevis. The disk 34 fastens to the clevises with fasteners 120, such as clevis pins, having shafts 122 that fit within the disk 34 peripheral slots 44, 45 and radial slot 41. The fastener 120 can extend through the mounting plate 96.

Figure 9:
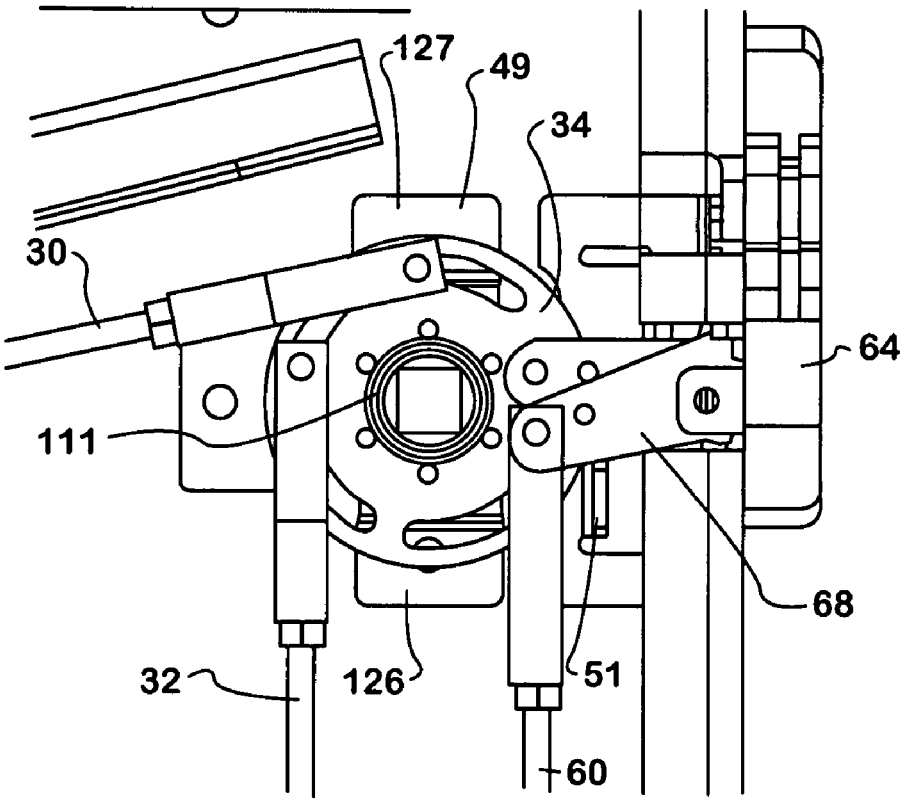
FIG. 9 is a front view a hub disk assembly of an embodiment of the invention.
Figure 15:
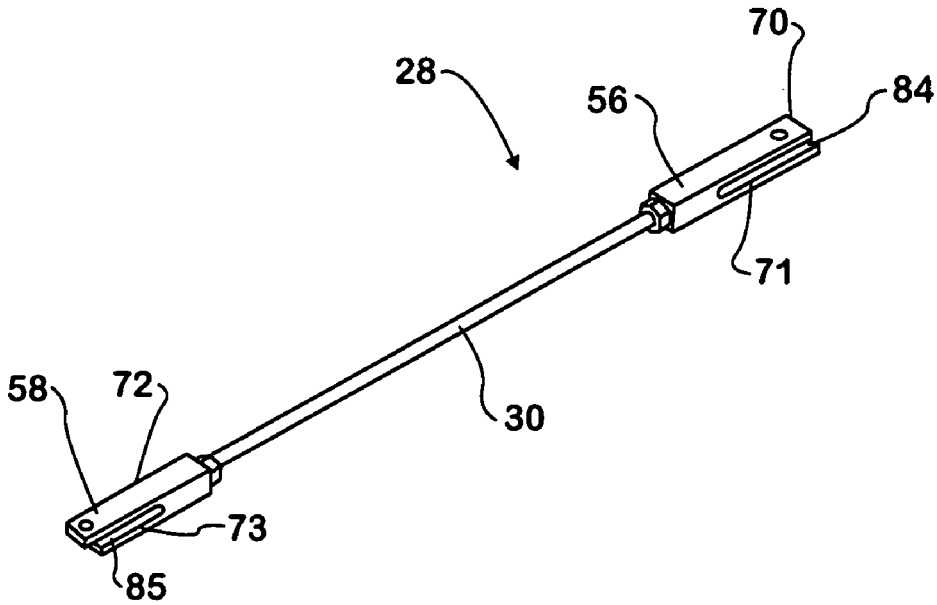
FIG. 15 is a perspective view of a handle connector.

As shown in FIG. 9, the hub assembly 16 can attach to one of the latches. Disk 34 is fastened to the upper latch assembly 64 at the peripheral slot 44 and at the first hole 42. The upper latch lever 68 and latch rod 60 both attach at the peripheral slot 44. In this embodiment, a retainer 111 is attached on the face of the disk 34 opposite the bearing shaft 76.

Figure 10:
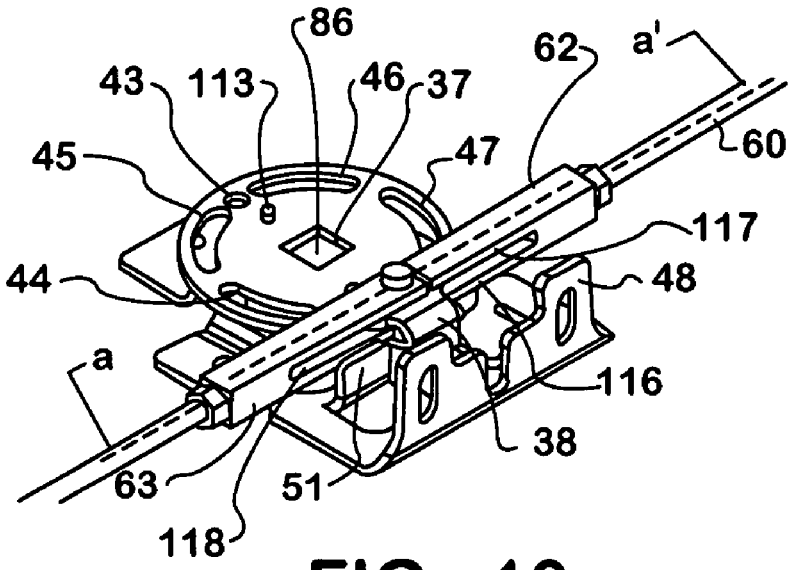
FIG. 10 is a perspective view of a hub disk assembly with two latch assemblies attached to the disk and a tension spring in a clockwise orientation.
Figure 11:
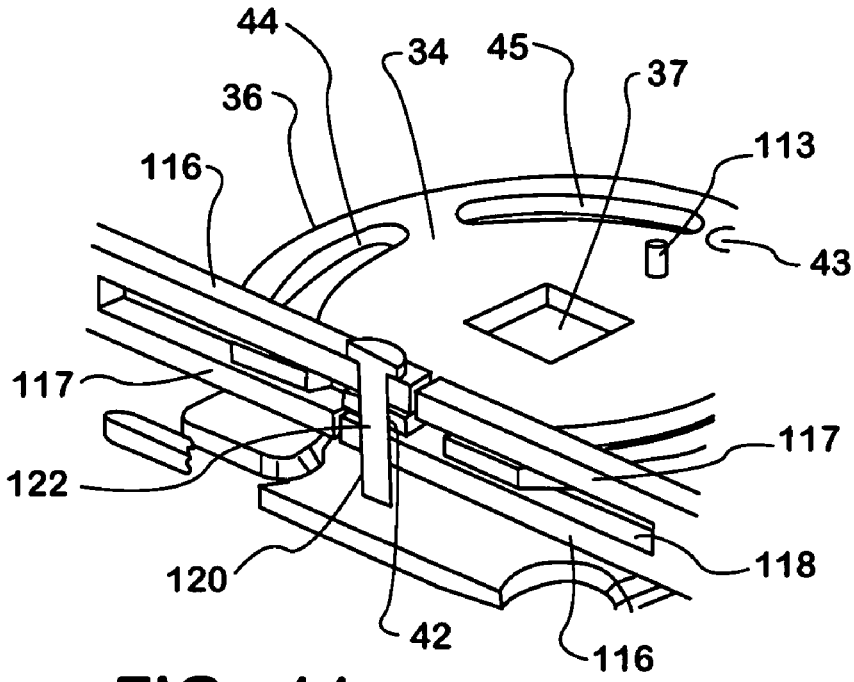
FIG. 11 is a partial perspective view of FIG. 10 with part of the hub assembly side removed along line a-a'.
Figure 12:
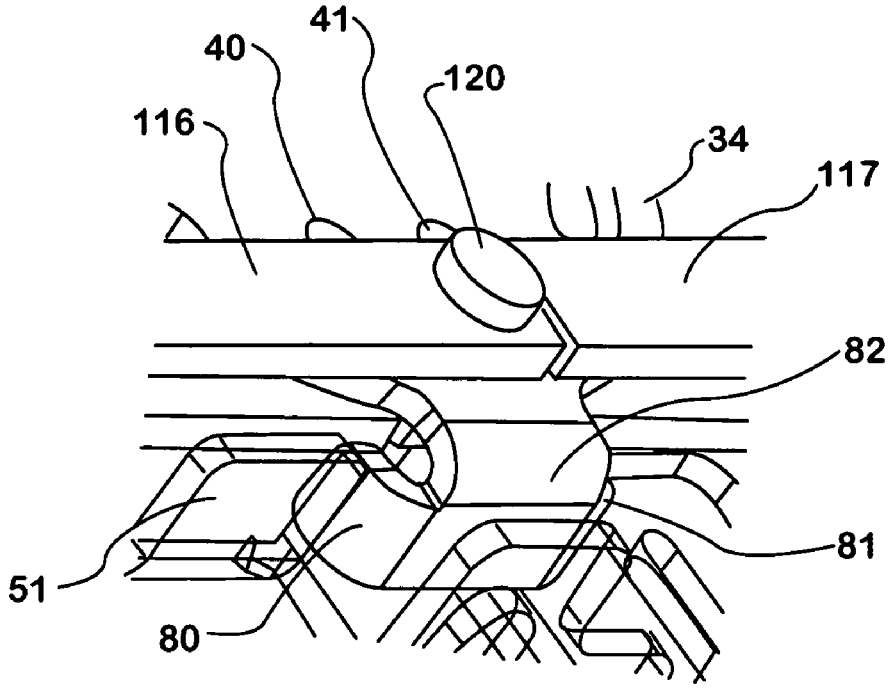
FIG. 12 is a partial close-up view of FIG. 10 showing the clevises of the two latch assemblies, the projection from the hub disk and the bracket in phantoms.

Alternatively as shown in FIGS. 10-12, the disk 34 can engage two latch rods 60 to allow the hub disk assembly to be located between the upper and lower latch assemblies 64, 66. The latch rods 60 have with upper and lower latch clevises 62, 63 with clevis arms 116, 117 of different lengths. The end 122 of the longer arms 116 of the upper and lower latch clevises 62, 63 overlap the end 123 of the shorter arms 117. This allows the use of only fastener 120 to secure the latch rods 60 to the disk 34 and disk bracket assembly 48. In this embodiment, the fastener 120 engages the first hole 42 of the disk 34.

Figure 16:
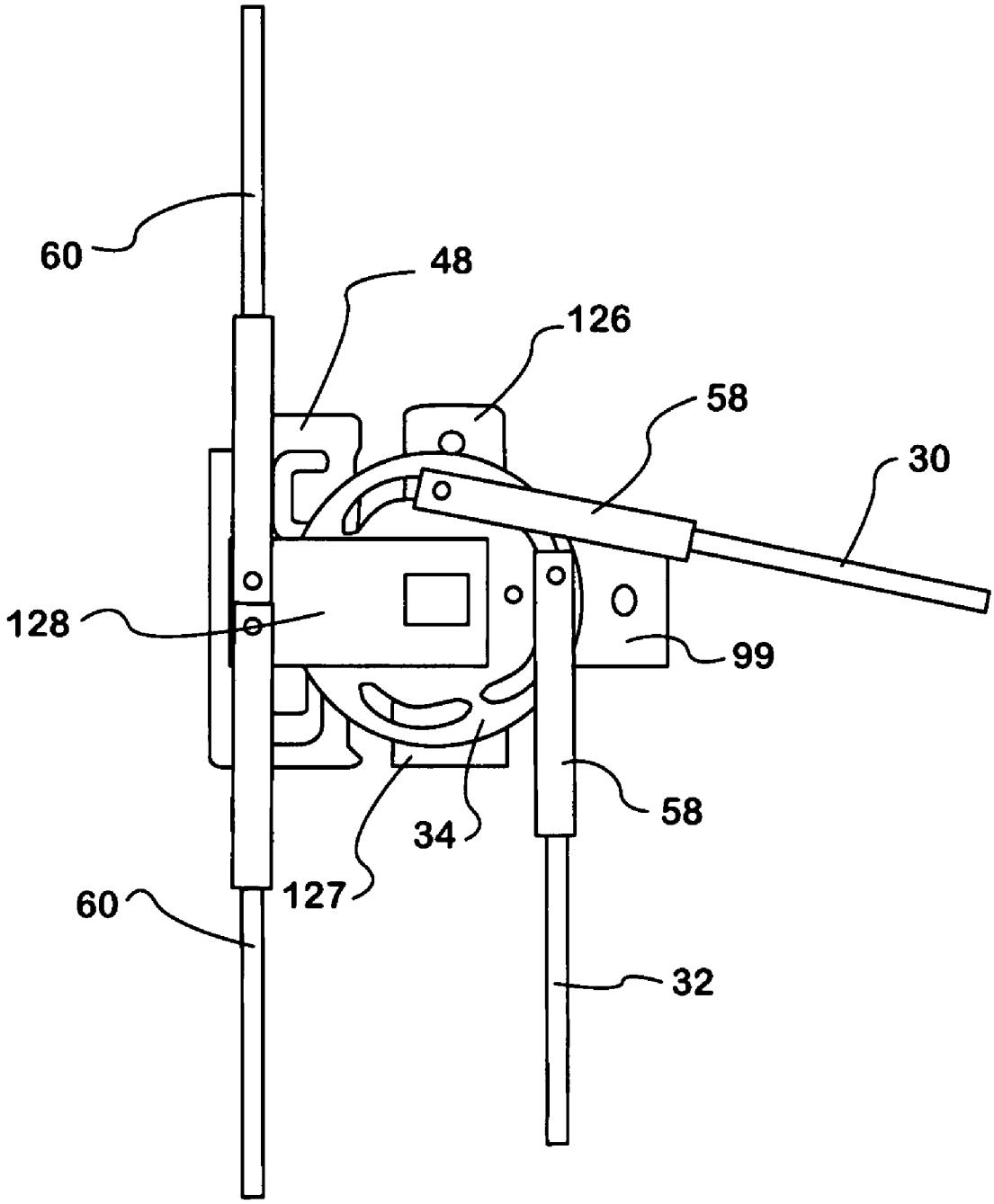
FIG. 16 is a front plan view of a hub disk assembly of another embodiment of the invention.

In another alternative shown in FIG. 16, a latch plate 128 engages the disk 34. The latch plate 128 secures two latch rods 60 to the disk 34 to allow the hub disk assembly to be located between the upper and lower latch assemblies 64, 66.

Figure 14:
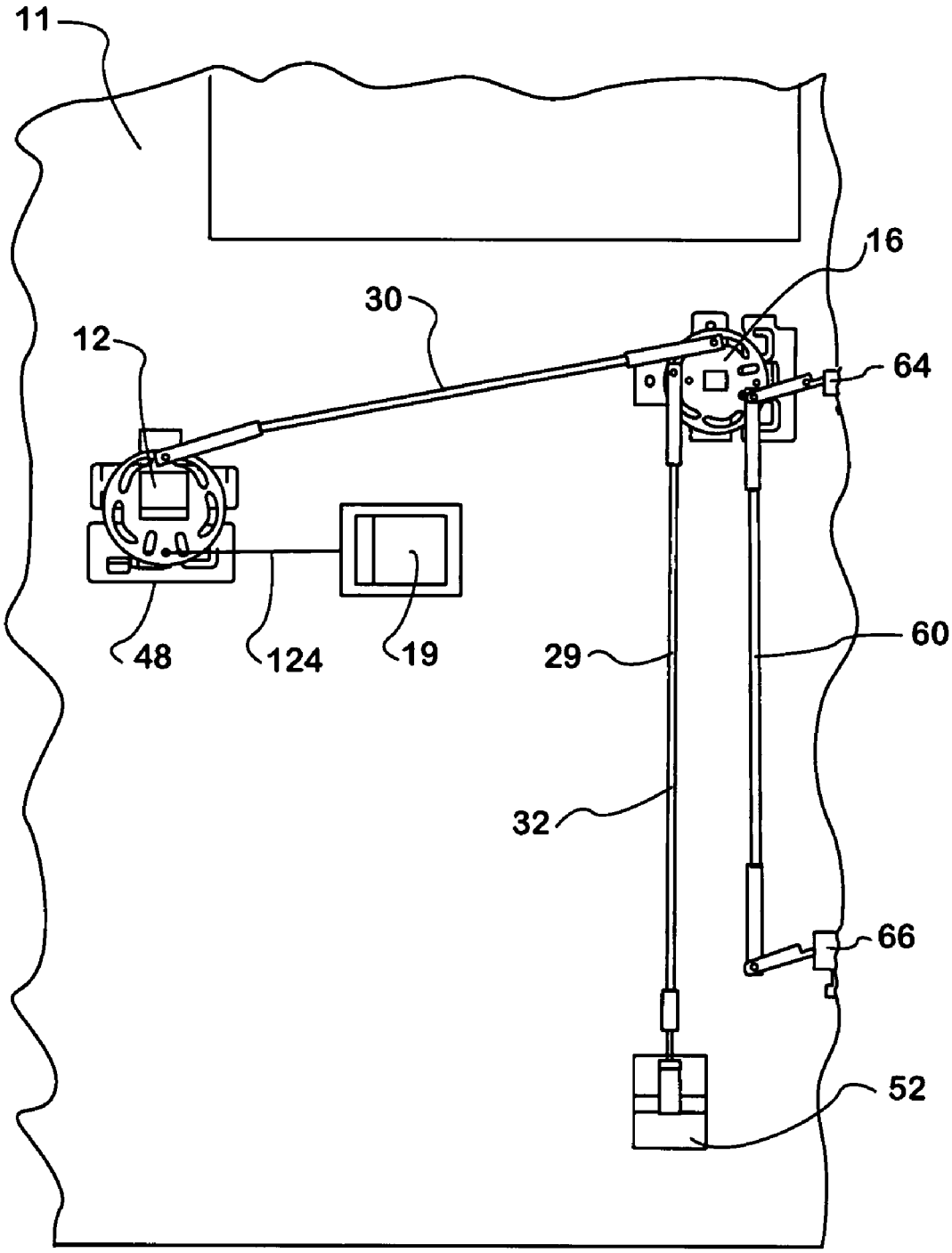
FIG. 14 is a partial front plan view of a door having paddle handles in another embodiment of the invention for a tension spring in a clockwise orientation.

The interior and exterior handles 18, 22 of the door latch assembly 10 can be rotating handles 18, 22, paddle handles 19, 52 (FIG. 14) or one of each type. When using paddle handles 19, 52, a handle connector can include a handle cable 124 or rod and attach directly to the handle disk at the first hole 42 from the paddle handle 19. Alternatively, handle connector 29 can attach directly the paddle handle, such as the inside part of exterior paddle handle 52.

Figure 13:
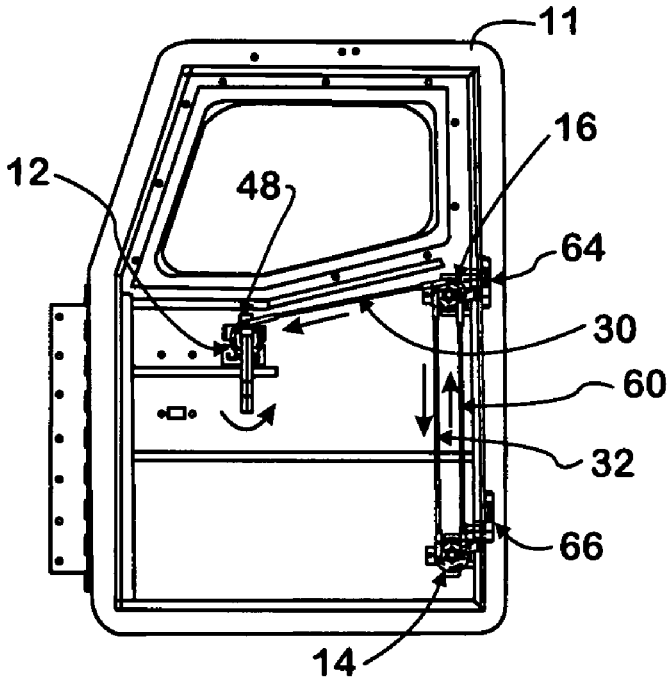
FIG. 13 is a front plan view of a door with the door latch assembly of the invention with a hub disk assembly incorporating the structures shown in FIG. 10 for a tension spring in a clockwise orientation and arrows designating the direction of movement.

To open the door 11 from the inside as shown in FIG. 13, the first handle 18 turns counterclockwise and moves the disk 34 of the first disk assembly 20 counterclockwise. This pulls the handle rod 30 leftward toward the interior handle 18. The handle rod 30 rotates the disk 34 of the hub assembly 16 counterclockwise. The disk 34 moves the second handle rod 30 downward, which rotates the disk 34 of the second disk assembly 14 counterclockwise. The disk 34 of the hub assembly 16 moves the latch rod 60 upward. This pulls the latch levers 68, 69 upward and out of the closed position to open both of the door latches 64, 66 and the door 11.

Closing the door forces the latch levers 68, 69 into the closed position. This releases the disk 34 of the hub assembly 16 and the spring 109. The spring 109 urges the disk 34 to rotate clockwise to return to the home position when the projection 38 reaches the disk bracket tab 51. Likewise, the disks of the first and second handle assemblies also return to their home positions.

There are a number of advantages of the door latching system of the invention. The cooperating disks eliminate the cables and thus the risk of breaking a cable. The system is more robust as rods are used, such as ¼" diameter rods.

The door latching system of the invention is versatile. As shown in the FIG. 14, the door latching system can be used with the paddle door handles. In the paddle handle system, a handle connector 124 can be used in the door latching assembly, such as the handle assembly 13. The handle connector 124 can have a cable or rod attached to a fastener fastened to the disk 34 of the first disk assembly 20 at the first hole 42. The external handle 52 attaches to a handle connector, such as the second rod 32. As shown in the other Figures, the system can be used with the rotating style door handles.

Another advantage of the door latching system of the invention is the system allows the use of multiple latches which are cooperatively opened from one handle, such as two or three latches for the door. The hardware can be used for multiple locations, such as the disk bracket assembly and the rotating disks for the internal and external handle assemblies and the hub assembly.

While the invention is shown in only one of its forms, it is not thus limited but is susceptible to various changes and modifications without departing from the spirit and scope of the invention.

What is claimed is:

1. A vehicle door latch assembly comprising:

a hub assembly having a disk bracket assembly and a hub disk assembly;

the hub disk assembly having a disk rotating between a first and a second position and a bearing shaft, the disk comprises an outer edge, a face, and a projection having a base extending laterally from the outer edge and curving toward the disk bracket, the bearing shaft extends from the face of the disk;

the disk bracket assembly having a mounting plate and a bracket tab projecting outwardly from the mounting plate;

an upper latch assembly operatively connected to the disk;

a latch rod having a first end connected to the disk and a second end;

a lower latch assembly operatively connected to the second end of the latch rod;

a handle assembly to operate the latch assemblies;

a handle connector connecting the handle assembly to the disk to rotate the disk from the first position toward the second position in order to move the latch assemblies to an unlatched position; and a spring engaging the disk and the disk bracket assembly to rotate the disk back to the first position until the projection engages the bracket tab.

2. A vehicle door latch assembly of claim 1, wherein the latch rod further comprises:

upper and lower latch clevises, each latch clevis having latch clevis arms, and a latch clevis slot therebetween;

a fastener fastening the latch clevis arms of one of the latch clevises to the disk; and wherein the outer edge of the disk fits within the latch clevis slot of one of the latch clevises.

3. A vehicle door latch assembly of claim 2, wherein the latch clevis arms are of different sizes.

4. A vehicle door latch assembly of claim 3, further comprising:

another latch rod connecting the hub assembly to the other latch assembly; and wherein the fastener fastens both latch rods to the hub assembly.

5. A vehicle door latch assembly of claim 1, further comprising:

another latch rod connecting the hub assembly to the other latch assembly; and a latch plate securing both latch rods to the disk of the hub assembly.

6. A vehicle door latch assembly of claim 2, further comprising:

a second handle assembly; and a second handle connector connecting the second handle assembly to the hub disk.

7. A vehicle door latch assembly of claim 6, wherein each handle connector further comprises:

a handle rod with opposite ends;

opposite first and second clevises being located at the ends of the handle rod, each clevis having opposite clevis arms, and a clevis slot therebetween;

an additional fastener fastening the clevis arms of one of the clevises to the disk; and wherein the outer edge of the disk fits within one of the clevis slots.

8. A vehicle door latch assembly of claim 7, wherein the handle assembly further comprises:

a second disk having an outer edge, and being spring mounted to a second disk bracket assembly; and wherein the outer edge of the second disk fits within a the clevis slot of the clevis of the first handle connector opposite the hub disk assembly.

9. A vehicle door latch assembly of claim 8, wherein the second handle assembly further comprises:

a third disk having an outer edge, and being spring mounted to a third disk bracket assembly; and wherein the outer edge of the third disk fits within the clevis slot of the clevis of the second handle connector opposite the hub disk assembly.

10. A door latching assembly, comprising:

a hub assembly having a disk bracket assembly and a hub disk rotatably mounting to the disk bracket assembly between a first and a second position;

a first handle assembly having a second disk bracket assembly and a second disk rotatably mounting to the second disk bracket assembly;

a first handle connector connecting the first handle assembly to the hub disk;

a second handle assembly having a third disk bracket assembly, and a third disk rotatably mounting to the third disk bracket assembly;

a second handle connector connecting the second handle assembly to the hub disk;

each disk bracket assembly having a mounting plate, a bracket tab projecting outwardly from the mounting plate, and a collar extending from the mounting plate;

each disk having a face and an outer edge with a projection having a base extending laterally from the outer edge and curving toward the disk bracket, and a bearing shaft extending from the face and inserting within the collar;

an upper latch assembly operatively connected to the hub disk;

a latch rod having a first end connected to the hub disk and a second end;

a lower latch assembly operatively connected to the second end of the latch rod;

wherein, when one of the handle assemblies is operated, the disk will rotate toward the second position to move the latch assemblies toward an unlatch position;

a spring engaging each disk and surrounding each collar to rotate the disk back to the first position until each projection engages their respective bracket tab.

11. A door latching assembly of claim 10, wherein the latch rod further comprises:

upper and lower latch clevises having clevis slots; and wherein an outer edge of the disk of the hub assembly engages one of the clevis slots of the latch rod.

12. A door latching assembly of claim 11, wherein each handle connector further comprises:

a handle rod with opposite ends;

opposite first and second clevises being located at the ends of the handle rod, each clevis having opposite clevis arms, and a clevis slot therebetween; and wherein the second clevis of each handle connector engages the outer edge of the disk of the hub assembly, the first clevis of the first handle connector engages an outer edge of the second disk of the first handle assembly, and the first clevis of the second handle connector engages an outer edge of the third disk of the second handle assembly.

13. A door latching assembly of claim 12, further comprising:

a first handle shank being mounted to the second disk of the first handle assembly; and a second handle shank being mounted to the third disk of the second handle assembly.

* * * * *